US011586148B2

(12) United States Patent
Jeanrenaud et al.

(10) Patent No.: US 11,586,148 B2
(45) Date of Patent: Feb. 21, 2023

(54) HOROLOGICAL CARRIAGE-STOP COMPRISING TWO RESILIENT STOP ELEMENTS

(71) Applicant: Omega SA, Biel/Bienne (CH)

(72) Inventors: Timothee Jeanrenaud, Yverdon-les-Bains (CH); Jean-Claude Monachon, Bevaix (CH)

(73) Assignee: Omega SA, Biel/Bienne (CH)

( * ) Notice: Subject to any disclaimer, the term of this patent is extended or adjusted under 35 U.S.C. 154(b) by 291 days.

(21) Appl. No.: 16/900,274

(22) Filed: Jun. 12, 2020

(65) Prior Publication Data

US 2021/0026301 A1 Jan. 28, 2021

(30) Foreign Application Priority Data

Jul. 23, 2019 (EP) ..... 19187810

(51) Int. Cl.
*G04B 17/28* (2006.01)

(52) U.S. Cl.
CPC ..... *G04B 17/285* (2013.01)

(58) Field of Classification Search
CPC .... G04B 17/285; G04B 27/004; G04B 27/02; G04B 27/007; G04B 3/006; G04B 17/06;
(Continued)

(56) References Cited

U.S. PATENT DOCUMENTS 6,846,104 B2 1/2005 Geyer
7,445,375 B2 11/2008 Kasapi
(Continued)

FOREIGN PATENT DOCUMENTS

CN 2030732 U 1/1989
CN 1270331 A 10/2000
(Continued)

OTHER PUBLICATIONS

European Search Report dated Jan. 14, 2020 in European Application 19187810.7 filed Jul. 23, 2019 (with English Translation of Categories of Cited Documents), 3 pages.
(Continued)

*Primary Examiner* — Edwin A. Leon
(74) *Attorney, Agent, or Firm* — Oblon, McClelland, Maier & Neustadt, L.L.P.

(57) ABSTRACT

A limiting device for a watch, including an oscillator, and capable of blocking this oscillator carried by the carriage of a tourbillon or karussel, with two intermediate drive wheels integral with arbors pivoted in a plate and rotating in opposite directions to one another, one whereof is driven in rotation by an engaging rod engaging with a control member external to the tourbillon or karussel, each of the intermediate wheels carries at least one resilient element, is arranged so as to bear against a mobile component of the oscillator in order to stop same upon passage of the control member from a rest position to an active position wherein each resilient element bears against this mobile component of the oscillator, or against the carriage, and so as to remain remote from the carriage and from any mobile component of the oscillator when the control member is in the rest position thereof.

11 Claims, 6 Drawing Sheets

(58) Field of Classification Search
CPC ..... G04B 19/02; G04B 1/12; G04B 17/063; G04B 17/04; G04B 17/26; G04B 17/045; G04C 3/08
See application file for complete search history.

(56) References Cited

U.S. PATENT DOCUMENTS

| | | | | |
|---|---|---|---|---|
| 8,356,929 | B2 * | 1/2013 | Zaugg | G04B 17/285 368/127 |
| 9,134,702 | B2 * | 9/2015 | Kasapi | G04B 17/00 |
| 9,958,833 | B2 * | 5/2018 | Sarchi | G04B 17/063 |
| 10,514,659 | B2 * | 12/2019 | Bazin | G04B 17/285 |
| 2004/0062149 | A1 | 4/2004 | Geyer | |
| 2010/0278017 | A1 | 11/2010 | Brossard et al. | |
| 2011/0164474 | A1 * | 7/2011 | Jolidon | G04F 7/0895 368/66 |

FOREIGN PATENT DOCUMENTS

| | | | |
|---|---|---|---|
| CN | 1950759 | A | 4/2007 |
| CN | 101154088 | A | 4/2008 |
| CN | 101156113 | A | 4/2008 |
| CN | 201141993 | Y | 10/2008 |
| CN | 101846962 | B | 1/2012 |
| CN | 106896699 | A | 6/2017 |
| EP | 1 164 441 | A1 | 12/2001 |
| EP | 2 246 752 | A1 | 11/2010 |
| EP | 2 583 143 | B1 | 3/2015 |
| EP | 2 871 536 | A1 | 5/2015 |
| EP | 2 793 087 | B1 | 6/2016 |
| WO | WO 00/04425 | A1 | 1/2000 |
| WO | WO 03/048871 | A2 | 6/2003 |
| WO | WO 2014/033312 | A1 | 3/2014 |

OTHER PUBLICATIONS

Combined Taiwanese Office Action and Search Report dated Nov. 30, 2020 in Taiwanese Patent Application No. 109120213 (submitting English translation only), 12 pages.
Combined Chinese Office Action and Search Report dated Jun. 3, 2021 in Patent Application No. 202010716932.1 (with English translation of Category of Cited Documents), 8 pages.

* cited by examiner

HOROLOGICAL CARRIAGE-STOP COMPRISING TWO RESILIENT STOP ELEMENTS

CROSS-REFERENCE TO RELATED APPLICATION

This application claims priority to European Patent Application No. 19187810.7 filed on Jul. 23, 2019, the entire disclosure of which is hereby incorporated herein by reference.

FIELD OF THE INVENTION

The invention relates to a horological limiting device for a watch, comprising an oscillator, and comprising means for limiting the variation of rate of this oscillator in the different positions of said watch in space, said device comprising at least one tourbillon or a karussel, which comprises a carriage which is mounted such that it pivots about a carriage axis relative to a plate, which carries a fixed wheel when said limiting device comprises a tourbillon, which carriage carries said oscillator and comprises a carriage wheel arranged so as to be driven by an energy source of the watch or of a movement by way of a gear train, and which carriage carries an escapement mechanism arranged so as to engage with said oscillator, and comprising an escape pinion meshing with said fixed wheel when said limiting device comprises a tourbillon or meshing with a third wheel or a fourth wheel, comprised in said gear train, when said limiting device comprises a karussel.

The invention further relates to a watch comprising a horological movement comprising energy storage means, an oscillator, hand-setting means, and such a limiting device.

The invention relates to the field of mechanical watches with high chronometric precision equipped with tourbillons or karussels, and so-called second-stop or carriage-stop mechanisms arranged so as to finely adjust the state of the watch.

BACKGROUND OF THE INVENTION

British patent No. 674764 filed by HEPTINSTALL discloses a spring-finger for blocking a balance.

European patent No. 1617305B1 filed by MONTRES BREGUET discloses control for manually stopping, via the stem, pad levers for blocking a balance.

European patent No. 2787400B1 filed by CHOPARD discloses a stop element, integral with a carriage such that it rotates therewith, and which is a disc coaxial to this carriage, axially displaced for axial friction with a balance.

European patent No. 2085832B1 filed by FREDERIC PIGUET discloses a friction clutch mechanism, by radial placing clutching elements at the ends of star-shaped arms in a cylindrical surface of a driving plate, under the axial effect of a clutch spring.

SUMMARY OF THE INVENTION

The invention proposes stopping a tourbillon or karussel carriage when setting the hands so as to adjust the watch to the nearest second.

For this purpose, the invention relates to a horological limiting device for limiting the variation of rate of an oscillator comprised in a watch, according to claim 1.

The invention further relates to a watch comprising a horological movement comprising energy storage means, an oscillator, hand-setting means, and such a limiting device.

BRIEF DESCRIPTION OF THE DRAWINGS

Other features and advantages of the invention will be better understood upon reading the following detailed description given with reference to the accompanying drawings, in which.

DETAILED DESCRIPTION OF THE PREFERRED EMBODIMENTS

Figure 1:
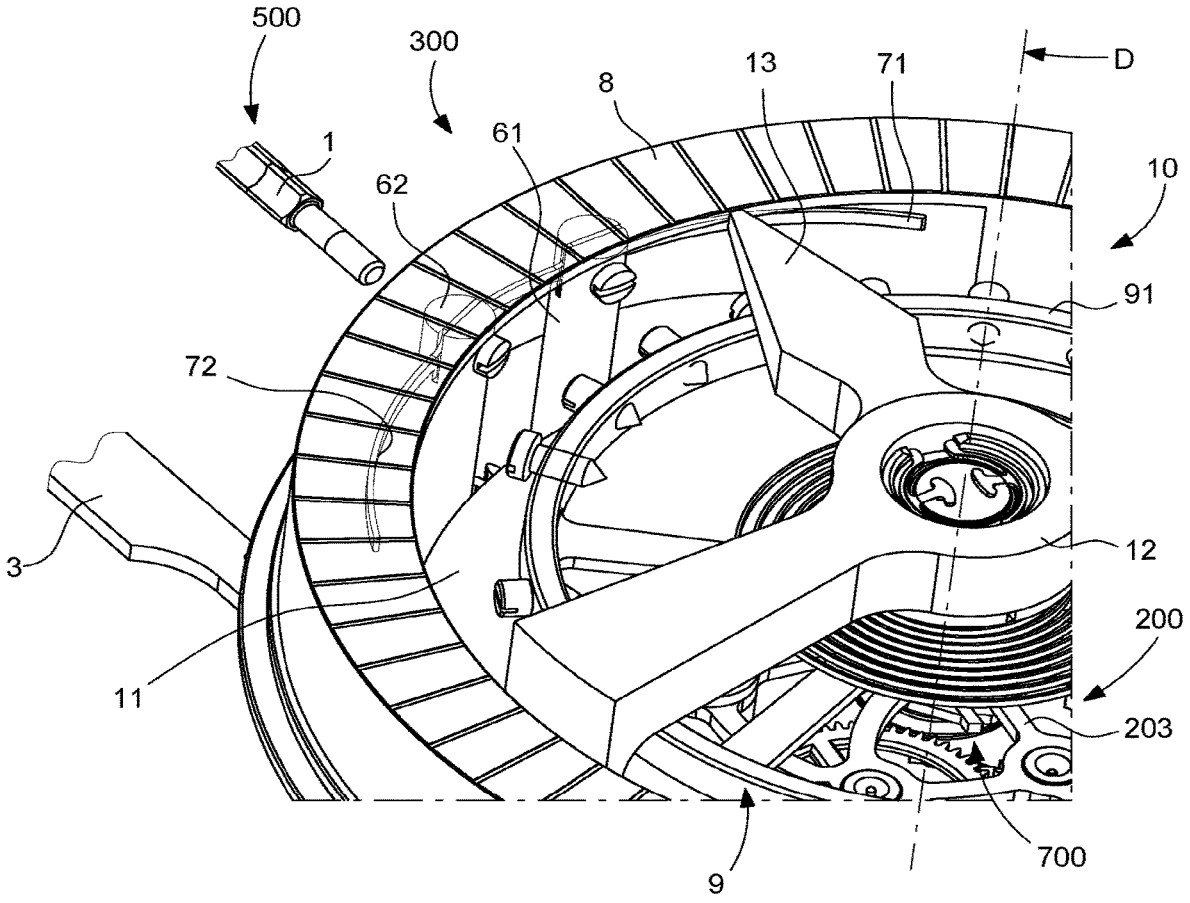
FIG. 1 diagrammatically shows a partial and perspective overhead view, i.e. as viewed by the user of the watch, of a horological limiting device for limiting the variation of rate of an oscillator, this sprung balance oscillator being carried by the carriage of a tourbillon; two arbors each carrying a resilient element in the cantilever position are pivoted in a plate, not shown, and the reverse rotation thereof is controlled by intermediate wheels shown beneath the lower bridge of the carriage of the tourbillon, and the rotation of one of the two thereof is controlled by an engaging rod moved by a control member of the watch, in this case formed by a winding and setting stem; a dial pipe shown transparently acts as a rear banking for the resilient elements, in this case presented in a rest position wherein the oscillator is free; this dial pipe advantageously constitutes a display scale, with which engages an index of the upper bridge of the carriage, shown above the balance.
Figure 2:
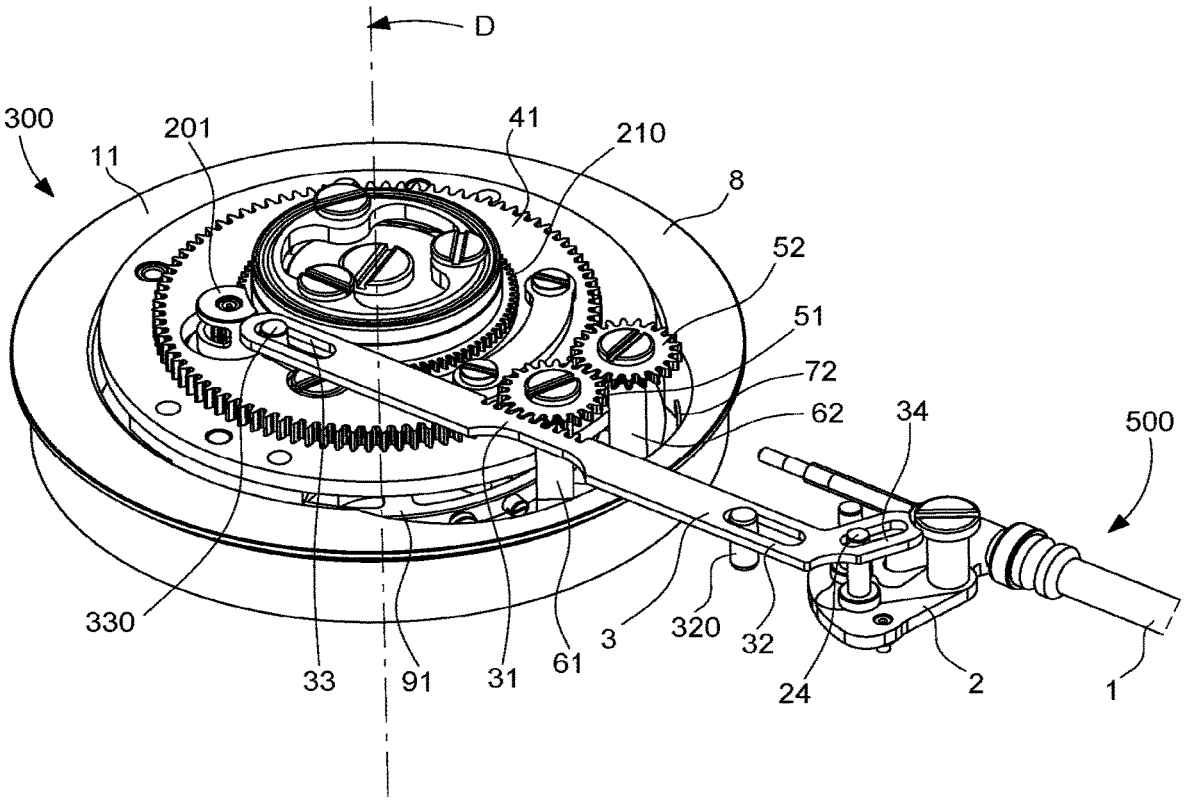
FIG. 2 shows, in a similar manner, a bottom view, i.e. a view from the opposite side, of the mechanism in FIG. 1, wherein the resilient elements are no longer visible, but wherein the articulated control mechanism of the engaging rod for actuating the intermediate wheels can be seen; this view shows, beneath the end of the rod located the furthest from the stem, the escape pinion which meshes with a fixed wheel to move the carriage; the positionings corresponding to positions T1 and T2 of the stem are shown in a superimposed manner.
Figure 3:
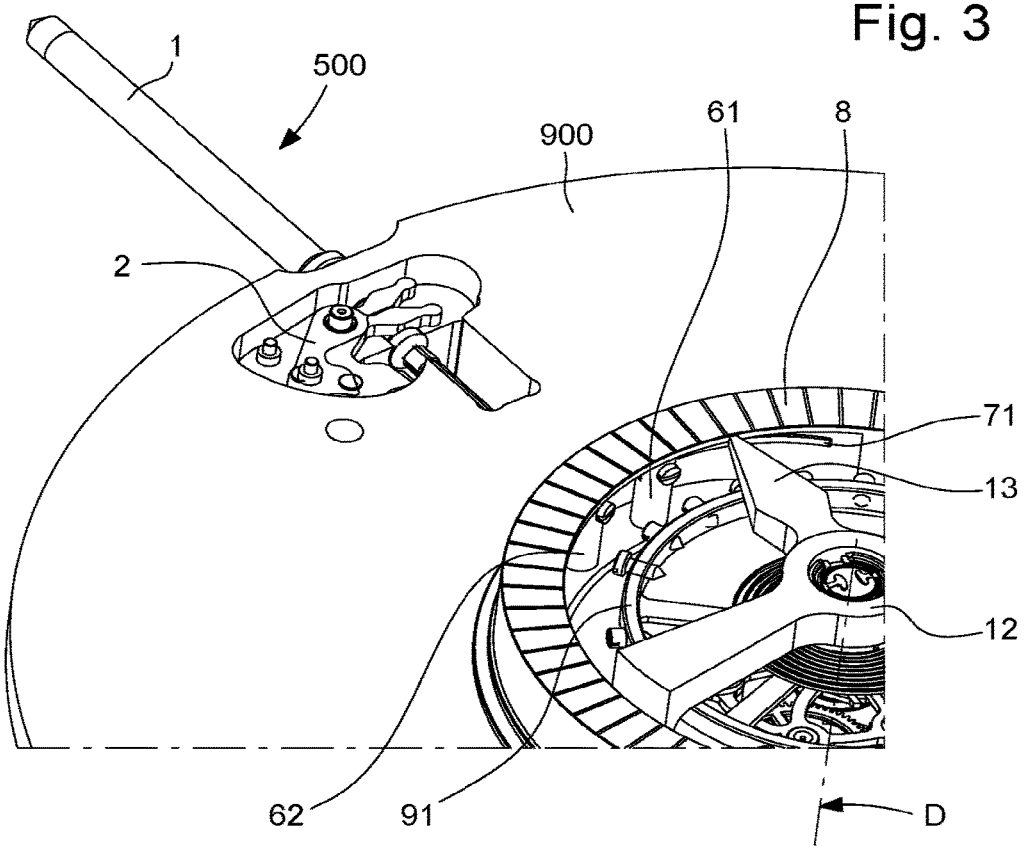
FIG. 3 is similar to FIG. 1, in the same rest position, and comprises the representation of the plate, with the control stem and the pull-out piece in the service position thereof.
Figure 4:
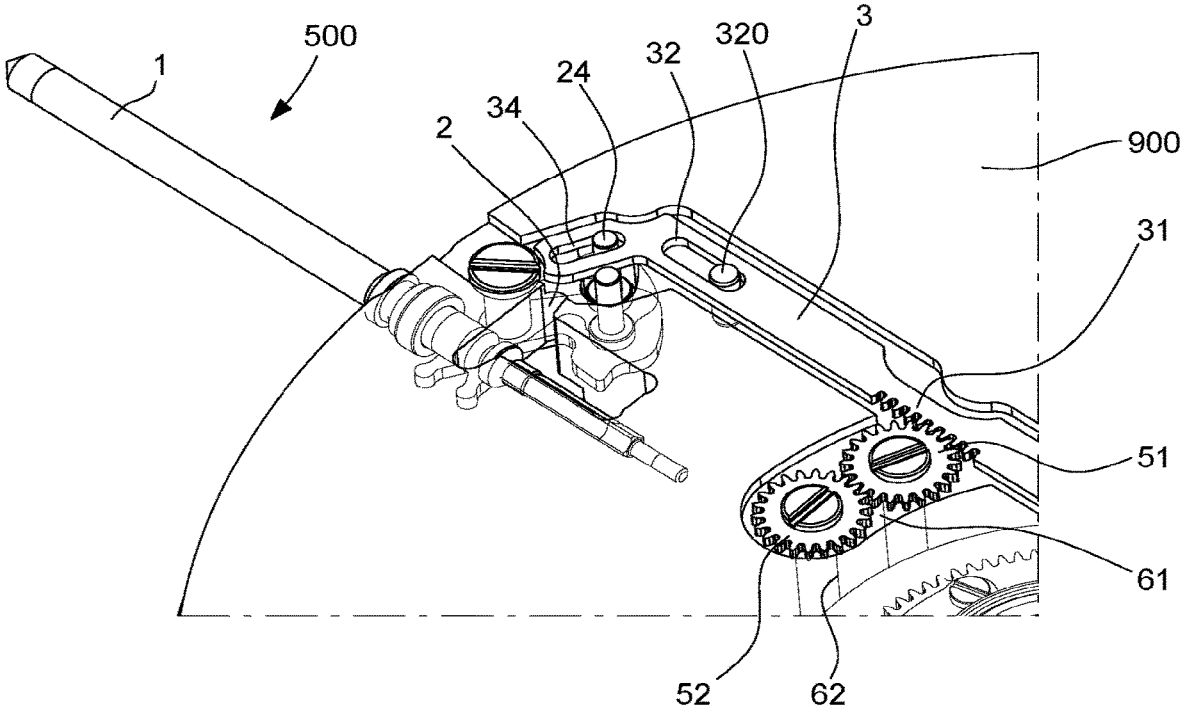
FIG. 4 is a detailed view in the position shown in FIG. 2, showing the articulations of the engaging rod, and the play of the two contra-rotating intermediate wheels.
Figure 5:
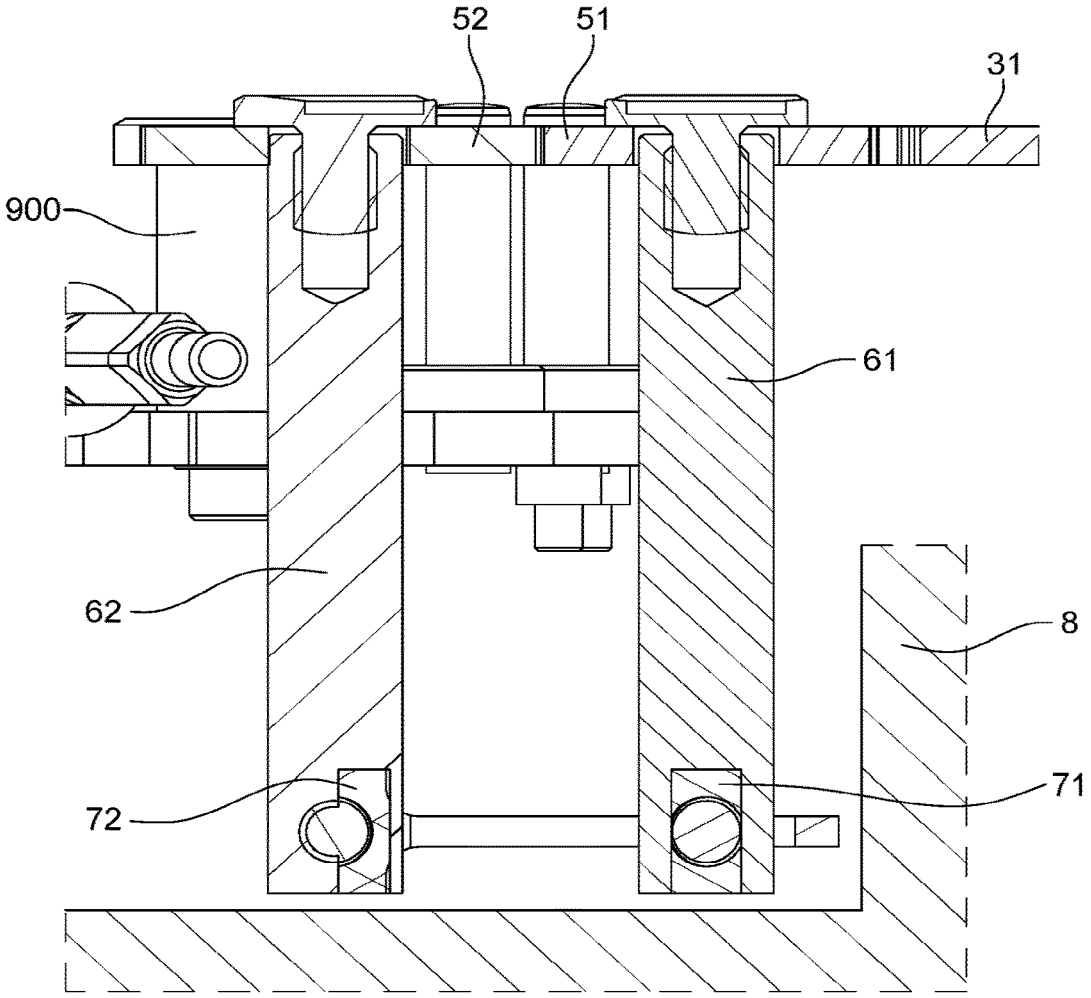
FIG. 5 diagrammatically shows a sectional view passing through the axes of the arbors of the intermediate wheels, the two movable assemblies, each formed by an intermediate wheel pinion, an arbor pivoted in the plate, and a resilient element, the latter being limited by the dial pipe.
Figure 10:
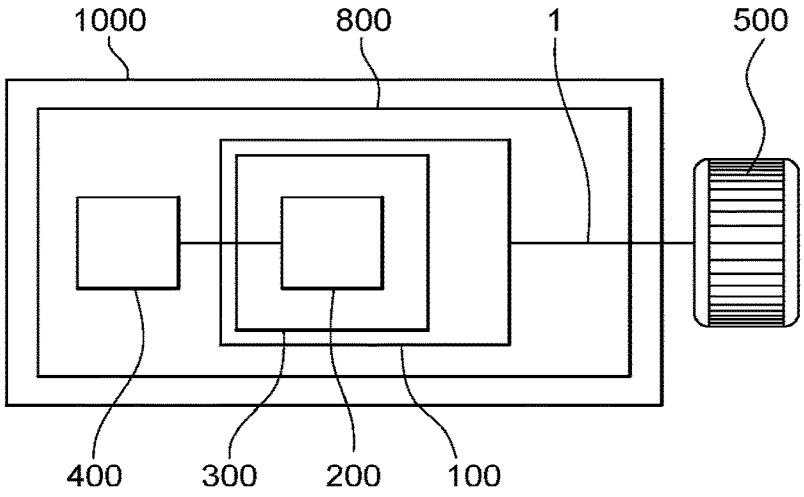
FIG. 10 is a block diagram showing a watch comprising a horological movement comprising energy storage means, an oscillator, hand-setting means, and such a limiting device.
Figure 6:
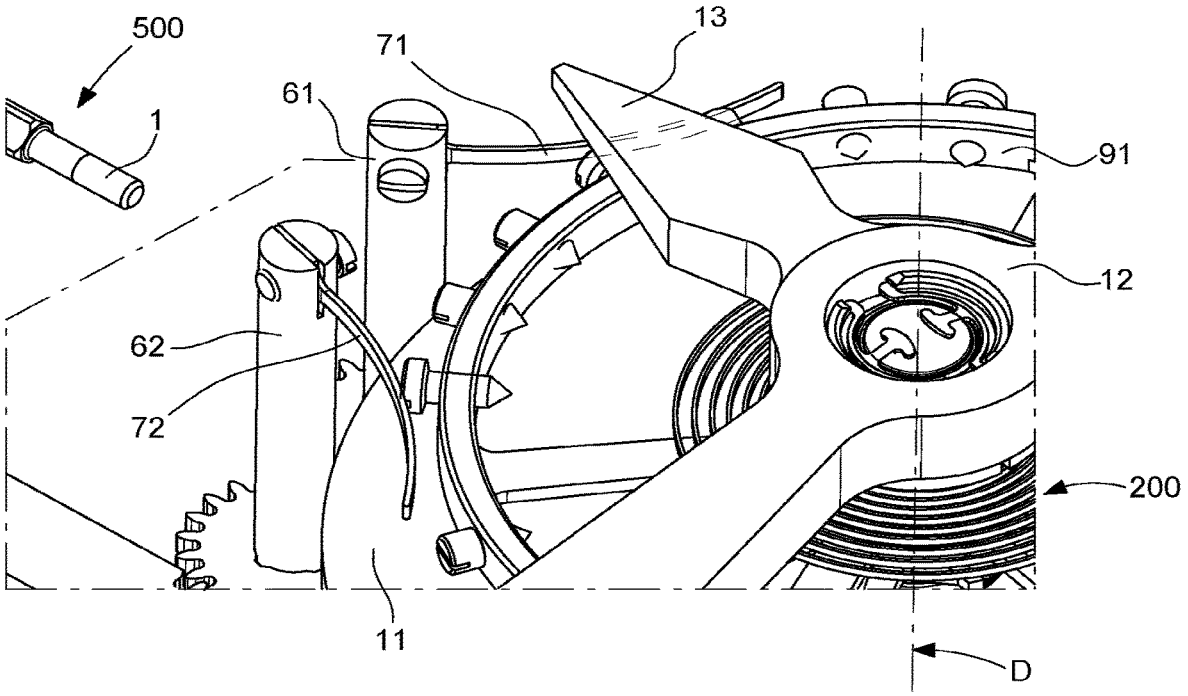
FIG. 6 shows, in a similar manner to FIG. 3, the same mechanism in an active position wherein the two resilient elements are bearing against the balance, and stop same by applying torques in opposite directions onto this balance.
Figure 7:
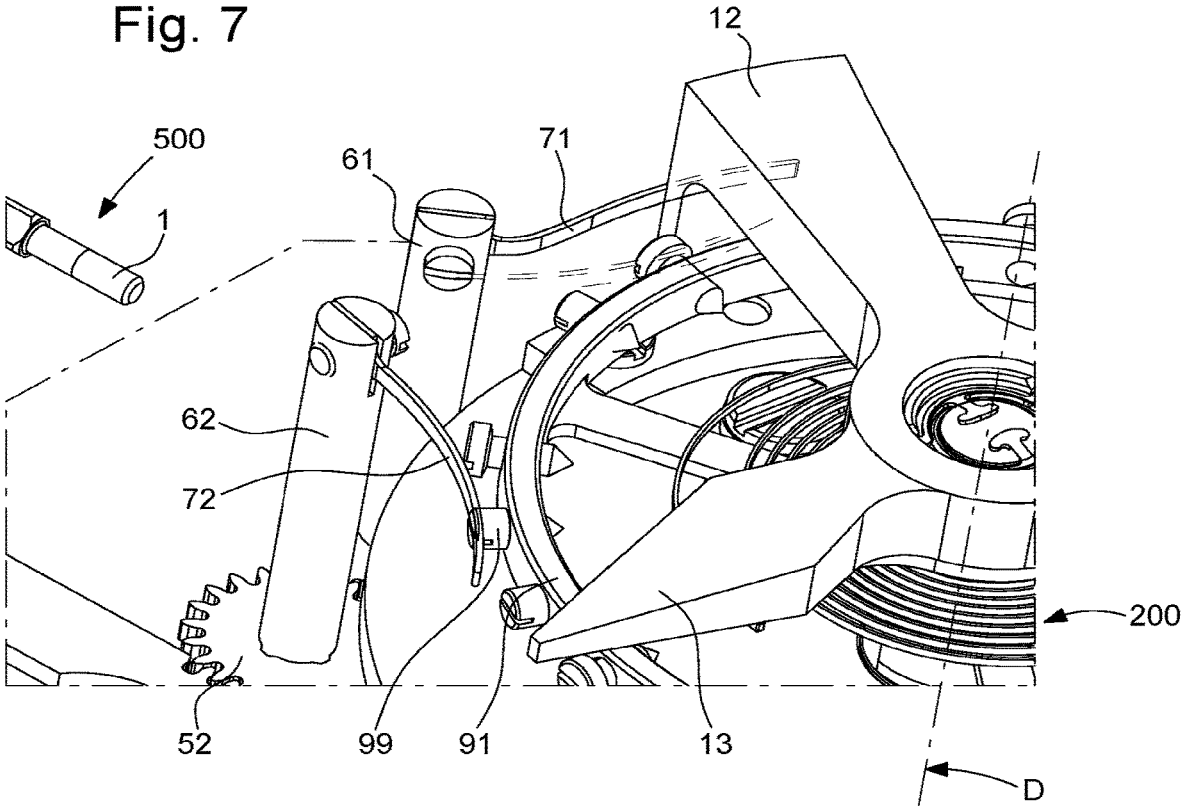
FIG. 7 shows, in a similar manner to FIG. 6, the same mechanism in an active position wherein, in this case, one of the two resilient elements bears against the balance, and the other against the upper bridge of the carriage of the tourbillon.
Figure 8:
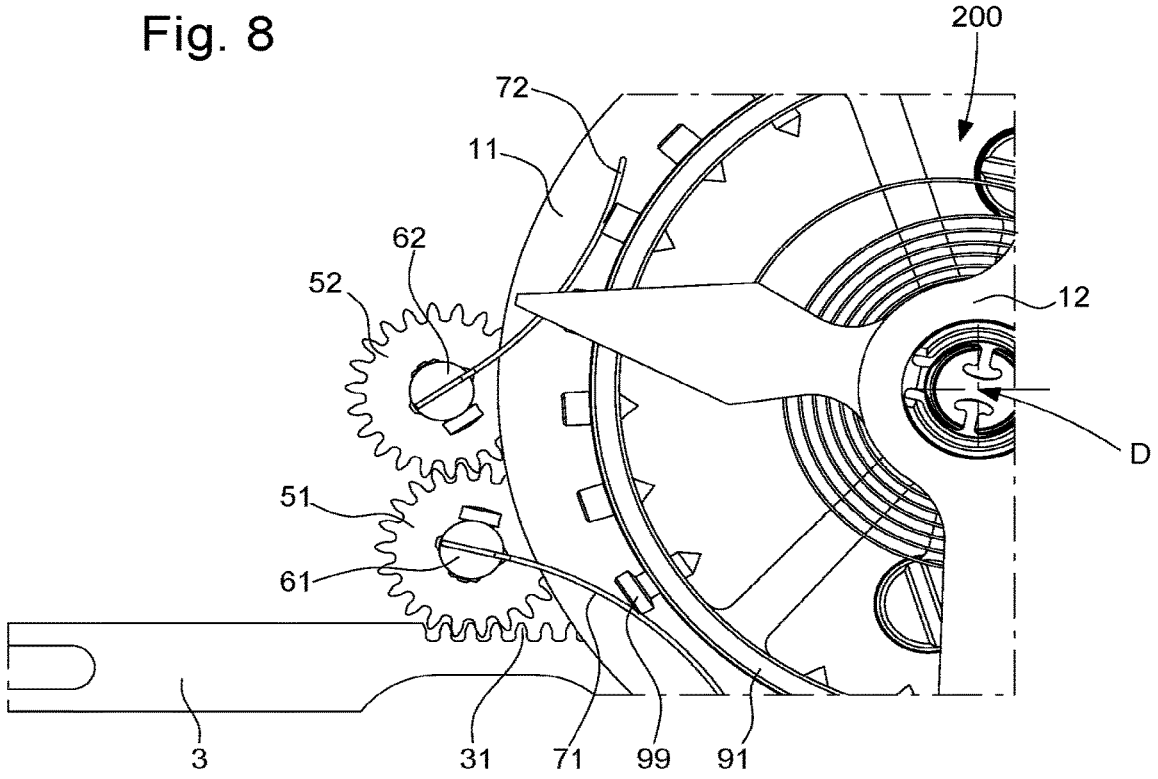
FIG. 8 is a partial overhead view corresponding to the position shown in FIG. 6.
Figure 9:
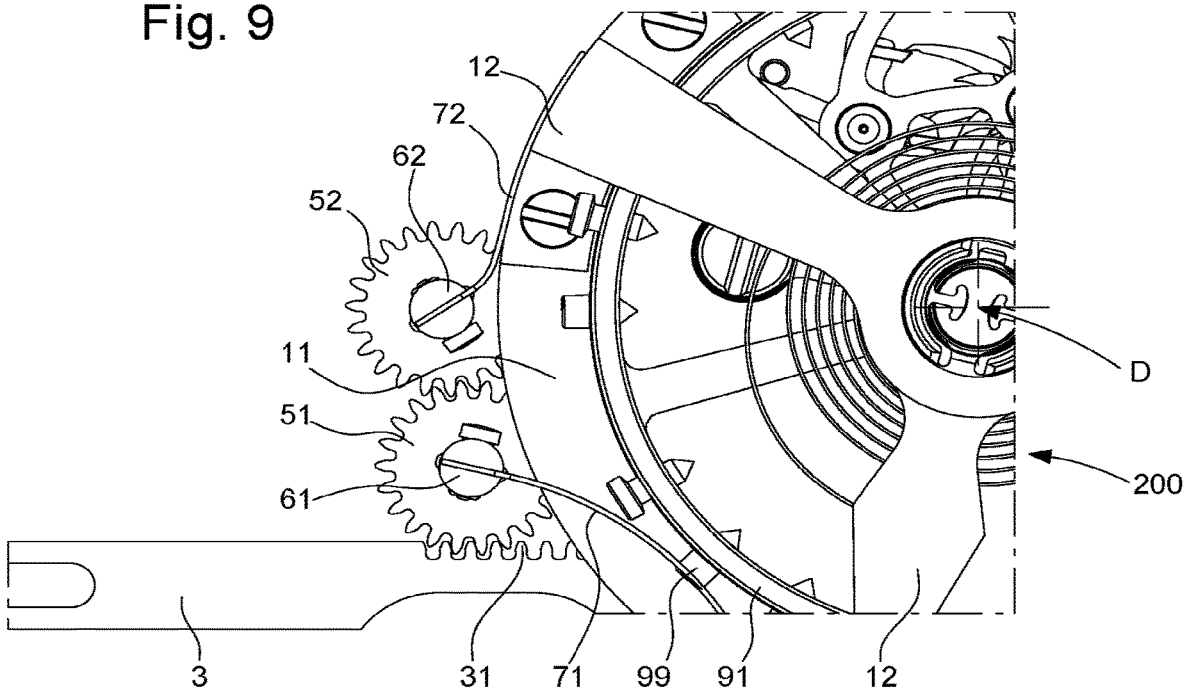
FIG. 9 is a partial overhead view corresponding to the position shown in FIG. 7.

The invention relates to the field of mechanical watches with high chronometric performance levels.

Known methods of improving insensitivity to the positions of a watch 1000 involve equipping it with a horological limiting device 100, comprising an oscillator, and capable of limiting the variation of rate of this oscillator 200, in the different positions of the watch 1000 in space.

This device 100 comprises at least one tourbillon 300 or a karussel which, in either case, comprises a carriage 10 which is mounted such that it pivots about a carriage axis D relative to a plate 900.

This plate 900 carries a fixed wheel 210 when the limiting device 100 comprises a tourbillon 300.

The carriage 10 comprises a lower bridge 11 and an upper bridge 12. The lower bridge 11 of the carriage 10 carries the oscillator 200, and comprises a carriage wheel 41, which is arranged so as to be driven by an energy source 400 of the watch 1000 or of a movement 800 comprised in the watch, by way of a gear train. This energy source 400 can in particular comprise at least one barrel or similar element.

The lower bridge 11 further carries a part of the escapement mechanism 700, which is arranged so as to engage with the oscillator 200, and which comprises an escape pinion 201.

An upper carriage bridge 12 protects both the oscillator 200 and the escapement mechanism 700 held by an escapement bridge 203; this upper bridge 12 can also protect a part of the mechanism according to the invention.

This escape pinion meshes with the fixed wheel 210 when the limiting device 100 comprises a tourbillon 300, or meshes with a third wheel or a fourth wheel, comprised in the gear train, when the limiting device 100 comprises a karussel.

The limiting device 100 according to the invention allows a mobile component of the oscillator 200 to be stopped, in particular an inertia mobile component such as a balance 91, carried by a tourbillon or karussel carriage 10, during the hand-setting operation. The mechanism is designed to also stop the carriage 10.

The figures show a specific alternative, non-limiting embodiment, wherein the mechanism according to the invention stops a sprung balance assembly, constituting the oscillator 200, on a carriage 10 comprised in a tourbillon 300, during the hand-setting operation.

Thus, relative to a conventional tourbillon or karussel, which comprises a carriage 10, which itself carries an oscillator 200, in particular but not limited to a sprung balance as shown in the figures, the mechanism according to the invention comprises a limited number of specific components, mounted on a carriage wheel 41 comprised in the carriage 10:

- an engaging rod 3, controlled by a control member of the watch, which in particular comprises, in the case shown in the figures, a winding and setting stem 1, articulated with a pull-out piece 2;
- two intermediate drive wheels 51 and 52 meshing with one another so as to rotate in opposite directions, and one whereof meshes with a rack 31, or a toothed sector, comprised in the engaging rod 3; each intermediate drive wheel 51, 52 is carried by a respective arbor 61, 62 pivoted in the plate 900;
- each intermediate drive wheel 51, 52 carries, at the other end of the arbor 61, 62 thereof, at least one resilient element 71, 72, itself comprising at least one resilient strip and/or at least one resilient wire, and which is arranged so as to bear against a mobile component of the oscillator 200, which is the balance 91 in the specific case shown in the figures, and which is also capable of bearing against the upper carriage bridge 12, and has, for this purpose, the required resilience for bearing against different diameters.

Advantageously, the mechanism according to the invention further comprises a dial pipe 8, arranged so as to house and protect the resilient elements 71 and 72.

Thus, according to the invention, the device 100 comprises a first intermediate drive wheel 51 and a second intermediate drive wheel 52, both pivoted in the plate 900 and rotating in opposite directions to one another, and one of the two thereof is driven in rotation by an engaging rod 3 arranged so as to engage with a control member external to the tourbillon 300 or karussel, for synchronous rotation of the first intermediate drive wheel 51 and of the second intermediate drive wheel 52 under the effect of a movement exerted by the control member.

The first intermediate drive wheel 51 and the second intermediate drive wheel 52 each carry at least one resilient element 71, 72, comprising at least one resilient strip and/or one resilient wire. Each resilient element 71, 72 is arranged so as to bear against at least one mobile component of the oscillator 200 in order to stop the oscillator 200 upon passage of the control member from a rest position to an active position wherein each resilient element 71, 72 bears against a mobile component of the oscillator 200, or against the upper bridge 12 of the carriage 10, and so as to remain remote from the upper bridge 12 and from any mobile component of the oscillator 200 when the control member is in the rest position thereof.

More particularly, the first intermediate drive wheel 51 and the second intermediate drive wheel 52 each have a sufficient angular displacement to allow a resilient element 71, 72 to bear against an upper bridge 12 of the carriage 10, when this bridge 12 enters the angular sector covered by the resilient element 71, 72 considered.

More particularly, the device 100 comprises hand-setting means 500, which constitute or control the control member, which is arranged so as to move the engaging rod 3 in a first activation direction upon the passage of the hand-setting means 500 from a rest position T1 to an activated position T2, and to move the engaging rod 3 in a second direction opposite the first direction upon the passage of the hand-setting means 500 from the activated position T2 to the rest position T1.

More particularly, the control member comprises a pull-out piece 2 mounted such that it pivots and arranged such that, during a translation of a control stem 1 controlling the pivoting of the pull-out piece 2, it causes a translation of the engaging rod 3, which comprises a rack 31, or a toothed sector, meshing with the first intermediate drive wheel 51 or the second intermediate drive wheel 52 for passing from the rest position to the activated position, or vice-versa.

More particularly, the tourbillon 300 or karussel comprises a dial pipe 8 comprising a substantially cylindrical wall about the carriage 10 thereof. Thus, in the rest position, the resilient elements 71, 72 are protected and concealed by the dial pipe 8, and are folded back in contact with the inner surface of the substantially cylindrical wall or in the immediate vicinity thereof.

More particularly, this dial pipe 8 comprises a substantially annular frontal display surface 81, facing which moves a display index 13 comprised in the carriage 10, for example to display the seconds or other information.

More particularly, each resilient element 71, 72 extends in the cantilever position relative to an arbor 61, 62, carrying the first intermediate drive wheel 51 or respectively the second intermediate drive wheel 52.

More particularly, each resilient element 71, 72 has a convex surface on the carriage 10 side.

More particularly, each resilient element 71, 72 comprises, opposite the respective arbor 61, 62 thereof, a distal end comprising a loop with a concavity in the same direction as the resilient element 71, 72, and a radius of curvature that is less than that of the part arranged so as to come into contact with the mobile component of the oscillator 200.

More particularly, the oscillator 200 is a sprung balance assembly.

The invention further relates to a watch 1000 comprising a horological movement 800 comprising energy storage means 400, an oscillator 200, hand-setting means 500, and such a limiting device 100 incorporating this oscillator 200.

More particularly, the tourbillon 300 or karussel constitutes a display member of the watch 1000, or is arranged so as to drive at least one display member of the watch 1, and the hand-setting means 500 constitute or control the control member.

The operating principle is as follows:

In the rest position T1, the mechanism is under the following conditions: The pull-out piece 2 is fixed, comprises a bezel pin 24 which holds in position a first slot 34 of the engaging rod 3, which, in this specific, non-limiting case, is capable of moving linearly thanks to two oblongs 32 and 33 which engage with pins 320 and 330 fixed in the plate 900. This rod 3 has a toothing 31 which meshes with one of the intermediate drive wheels 51, 52. This driven intermediate wheel meshes with the other intermediate drive wheel. These two intermediate wheels are integral with pivot arbors 61, 62 at one of the ends thereof, and create the play of the assembly between the plate 900 and a bridge, in particular a barrel bridge. The resilient elements 71, 72 are situated on the other end of the arbors 61, 62, and are advantageously tensioned against the dial pipe 8. The tourbillon carriage 10 is free to rotate inside the dial pipe 8, the resilient elements 71, 72 not being in the path of travel of the sprung balance 9.

In position T2, the mechanism is under the following conditions:

The winding stem 1 is pulled out and displaces the pull-out piece 2 into position T2. The pull-out piece 2 thus displaces the engaging rod 3. Through the movement thereof, it causes the intermediate drive wheels 51, 52 to pivot. The first intermediate wheel pivots in one direction and the second in the opposite direction. Being integral with the pivot arbors 61, 62, which carry the resilient elements 71, 72, the rotation of the intermediate drive wheels 51, 52 detaches the resilient elements 71, 72 from the wall of the dial pipe 8 and brings them into contact with the sprung balance 9.

At this precise moment in time, two situations can exist:

- the resilient elements 71, 72 both come into contact with the sprung balance 9 and stop the carriage 10 of the tourbillon;
- only one of the resilient elements 71, 72 comes into contact with an arm of the tourbillon carriage and the other of the resilient elements 71, 72 comes into contact with the balance 91. This also causes the carriage 10 to stop.

The arrangement of the elements (intermediate wheels 51, 52, arbors 61, 62, and resilient elements 71, 72) guarantees that in any angular position of the tourbillon carriage 10, if a resilient element 71, 72 touches an arm of the upper bridge 12 of the carriage 10, the other of the resilient elements 71, 72 must be touching the balance 91.

To summarise, the invention allows:

- an inertial mass of an oscillator, in particular a balance, to be instantly stopped;
- a tourbillon or karussel carriage to be instantly stopped;
- the oscillator to be restarted after a hand-setting operation, for which the oscillator has been stopped;
- the time to be set to the nearest second;
- the carriage to be stopped regardless of the angular position of the tourbillon or karussel;
- the device to be concealed inside the dial pipe; and without overloading the carriage.

This mechanism is compact, the manufacture thereof requires conventional technology and the cost thereof is thus low.

The invention claimed is:

1. A horological limiting device for a watch, comprising:

an oscillator, the horological limiting device limiting a variation of rate of said oscillator in different positions of said watch;

at least one tourbillon or a carousel, which comprises a carriage which is mounted such that the carriage pivots about a carriage axis relative to a plate carrying a fixed wheel, which carries said oscillator and comprises a carriage wheel being driven by an energy source of the watch or of a movement by way of a gear train, and which carries an escapement mechanism engaging with said oscillator, and an escape pinion meshing with said fixed wheel when said limiting device comprises the tourbillon or with a third wheel or a fourth wheel, comprised in said gear train, when said limiting device comprises the carousel, wherein said device is configured to block said oscillator; and a first intermediate drive wheel and a second intermediate drive wheel, integral with arbors both pivoted in said plate and rotating in opposite directions to one another, one of the two thereof being driven in rotation by an engaging rod engaging with a control member external to said tourbillon or carousel, for synchronous rotation of said first intermediate drive wheel and of said second intermediate drive wheel under an effect of a movement exerted by said control member, wherein said first intermediate drive wheel and said second intermediate drive Wheel each carry at least one resilient element, comprising at least one resilient strip and/or one resilient wire, bearing against at least one mobile component of said oscillator in order to stop said oscillator upon passage of said control member from a rest position to an active position, and each said resilient element bears against a mobile component of said oscillator, or against an upper bridge of said carriage, and remains remote from said upper bridge and from any mobile component of said oscillator when said control member is in said rest position thereof.

2. The limiting device according to claim 1, wherein said first intermediate drive wheel and said second intermediate drive wheel each have an angular displacement to allow said resilient element to bear against the upper bridge of said carriage.

3. The limiting device according to claim 1, further comprising a hand-setting stem, which constitutes or is configured to control said control member, wherein the control member is configured to move said engaging rod in a first activation direction upon a passage of said hand-setting stem from a rest position T1 to an activated position T2, and to move said engaging rod in a second direction opposite said first direction upon the passage of said hand-setting stem from said activated position T2 to said rest position T1.

4. The limiting device according to claim 1, wherein said control member comprises a pull-out piece mounted such that it pivots and arranged such that, during a translation of a control stem controlling a pivoting of said pull-out piece, it causes a translation of said engaging rod, which comprises a rack meshing with said first intermediate drive wheel or said second intermediate drive wheel for passing from the rest position to the activated position, or vice-versa.

5. The limiting device according to claim 1, wherein said tourbillon or carousel comprises a dial pipe comprising a cylindrical wall about said carriage thereof, and wherein, in said rest position, said resilient elements are protected and concealed by said dial pipe, and are folded hack in contact with an inner surface of said cylindrical wall or in an immediate vicinity thereof.

6. The limiting device according to claim 5, wherein said dial pipe comprises a annular frontal display surface, facing which moves a display index comprised in said carriage.

7. The limiting device according to claim 1, wherein each said resilient element extends in a cantilever position relative to said arbor carrying said first intermediate drive wheel or respectively second intermediate drive wheel.

8. The limiting device according to claim 1, wherein each said resilient element has a convex surface on a carriage side.

9. The limiting device according to claim 1, wherein each said resilient element comprises, opposite the respective arbor thereof, a distal end comprising a loop with a concavity in the same direction as said resilient element, and a radius of curvature that is less than that of a part arranged so as to come into contact with said one mobile component of the oscillator.

10. The limiting device according to claim 1, wherein said oscillator is a sprung balance assembly.

11. A watch comprising a horological movement, comprising:

an energy storage;

a hand-setting stem; and the horological limiting device according to claim 1, comprising said oscillator, wherein said tourbillon or carousel constitutes a display member of said watch, or is configured to drive at least one display member of said watch, and said hand-setting stem constitutes or is configured to control said control member.

* * * * *